US005110455A

United States Patent [19]

Huch

[11] Patent Number: 5,110,455

[45] Date of Patent: May 5, 1992

[54] METHOD FOR ACHIEVING ENHANCED COPPER FLOTATION CONCENTRATE GRADE BY OXIDATION AND FLOTATION

[75] Inventor: Richard O. Huch, Tucson, Ariz.

[73] Assignee: Cyprus Minerals Company, Englewood, Colo.

[21] Appl. No.: 626,825

[22] Filed: Dec. 13, 1990

[51] Int. Cl.[5] ..... B03D 1/002; B03D 1/018; B03D 1/02; B03D 1/06

[52] U.S. Cl. ..... 209/167; 209/166

[58] Field of Search ..... 209/166, 167, 901; 252/61

[56] References Cited

U.S. PATENT DOCUMENTS

| | | | |
|---|---|---|---|
| 1,397,703 | 11/1921 | Robbins | 209/167 |
| 1,554,220 | 9/1925 | Lewis | 209/167 |
| 1,728,352 | 9/1929 | Lowe | 209/167 |
| 1,869,532 | 8/1932 | Weinig | 209/167 |
| 1,973,558 | 9/1934 | Brinker | 209/167 |
| 2,012,830 | 8/1935 | Ralston | 209/167 |
| 2,105,901 | 1/1938 | Brinker | 209/167 |
| 2,898,196 | 8/1959 | Forward | 209/166 |
| 3,137,649 | 6/1964 | DeBenedictis | 209/167 |
| 4,083,921 | 4/1978 | Wesely . | |
| 4,362,552 | 12/1982 | Petrovich . | |
| 4,561,970 | 12/1985 | Heimala | 209/166 |

FOREIGN PATENT DOCUMENTS

| | | | |
|---|---|---|---|
| 56-141856 | 11/1981 | Japan . | |
| 8700088 | 1/1987 | World Int. Prop. O. | 209/167 |

OTHER PUBLICATIONS

"Handbook of Mineral Dressing" by A. Taggart, copy 1945, pp. (12-112 to 12-116).

*Primary Examiner*—Stanley S. Silverman
*Assistant Examiner*—Thomas M. Lithgow
*Attorney, Agent, or Firm*—Sheridan Ross & McIntosh

[57] ABSTRACT

The present invention involves a method for separating copper sulfide from rimmed iron sulfide by flotation. Prior to flotation, a slurry containing the sulfides is oxidized and conditioned to achieve a pH greater than pH 9. Thereafter, the slurry is subjected to a froth floatation process by which a copper sulfide, such as chalcopyrite, concentrate is recovered.

20 Claims, 1 Drawing Sheet

METHOD FOR ACHIEVING ENHANCED COPPER FLOTATION CONCENTRATE GRADE BY OXIDATION AND FLOTATION

FIELD OF THE INVENTION

The present invention relates to the separation of minerals by froth flotation, and in particular a method for separating chalcopyrite from concentrates containing copper rimmed pyrite and chalcopyrite, including the step of treating the concentrate with an oxidizing agent.

BACKGROUND OF THE INVENTION

A major operation in mineral processing involves the separation of desirable minerals from ore bodies within which the minerals are contained. Froth flotation is a common technique employed to facilitate such separation. In froth flotation, ground ore is typically fed as an aqueous slurry to froth flotation cells. The chemistry of the slurry is adjusted such that certain minerals selectively attach to air bubbles which rise upward through the slurry and are collected in froth near the top of a flotation cell. Thereafter, minerals in the froth can be separated from different minerals in the cell.

The surfaces of specific mineral particles in aqueous suspension are treated with chemicals called flotation reagents or collectors. Flotation reagents provide the desired mineral to be floated with a water-repellent air-avid coating that will easily adhere to an air bubble, which will raise the mineral through the slurry to the surface.

The valuable mineral separated and collected during the froth flotation process may be either the froth product or the underflow product. Froth is generated by vigorous agitation and aeration of the slurry in the presence of a frothing agent.

Other chemical agents can be added to the slurry to aid in separation, such as depressants or modifiers. The presence of depressants in a float generally assists in selectivity and/or stops unwanted minerals from floating. Modifiers facilitate collection of desired minerals. Modifiers include several classes of chemicals such as activators, alkalinity regulators, and dispersants. Activators are used to make a mineral surface amenable to collector coatings. Alkalinity regulators are used to control and adjust pH, an important factor in many flotation separations. Dispersants are important for control of slimes which sometimes interfere with selectivity and increase reagent consumption.

One difficulty encountered in froth flotation is the separation of chalcopyrite from a concentrate comprised of chalcopyrite and copper rimmed iron sulfide, typically pyrite. As used herein, the terms "copper rimmed" and "rimmed" refer to a copper sulfide coating which forms on at least part of the surface of iron sulfide, and in particular, pyrite. This coating forms in geological formations when, over a long period of time, chalcocite and covellite replace pyrite on the surface of the mineral.

Typically a chalcopyrite/pyrite slurry is conditioned with lime in order to raise the pH. The slurry is subjected to a copper flotation process, using a collector and frother as required. However, when copper rimmed pyrite is encountered, the process is unsatisfactory due to inefficiency in achieving the desired separation of chalcopyrite from pyrite. By way of example, a typical traditional process yields a copper concentrate which assays about 10 weight percent to about 17 weight percent copper after flotation, as opposed to a theoretical maximum of about 33 weight percent copper if the concentrate is 100 percent chalcopyrite. The main diluent is typically copper rimmed pyrite which floats with the chalcopyrite.

Practitioners of the froth flotation art have sought to separate chalcopyrite from rimmed pyrite, but have met with limited success. One method which has been employed to enhance the separation of chalcopyrite from copper rimmed pyrite is to grind the rimmed pyrite to an extremely fine size, e.g., less than 625 mesh. In this way, particles are formed which have little or no copper sulfide coating on their surfaces and the chalcopyrite is separated from these non-rimmed particles using conventional flotation techniques. However, it is relatively expensive to grind the minerals to such an extremely fine size, and the degree of separation may still be less than desired.

As a result, it would be advantageous to have a process for efficiently and economically separating chalcopyrite from copper rimmed iron sulfides. In particular, it would be advantageous to have a froth flotation process for effectively separating chalcopyrite from copper rimmed pyrite. It would be advantageous if the process for separating chalcopyrite from rimmed pyrite could be accomplished using ordinary froth flotation equipment and would result in a copper concentrate having a relatively high concentration of copper.

SUMMARY OF THE INVENTION

The present invention involves a method for enhanced concentration of chalcopyrite from a low grade concentrate containing copper rimmed iron sulfide by use of a froth flotation process. The present process provides numerous advantages, including the ability to recover higher concentrations of chalcopyrite in a more efficient and effective manner than has previously been available. In a preferred embodiment of the present process, an aqueous suspension of a low grade concentrate including chalcopyrite and rimmed pyrite is conditioned with an oxidizing agent. Examples of such oxidizing agents include peroxides (preferably hydrogen peroxide), ozone and persulfates. The slurry is then conditioned to achieve a pH greater than about pH 9 and preferably greater than about pH 11, and is subjected to a froth flotation process by which chalcopyrite is selectively floated.

The new process results in a purer chalcopyrite concentrate than previously obtained in the presence of copper rimmed pyrite. The concentrate can be subjected to normal recovery processes, such as smelting. Due to the higher concentration of the copper in the concentrate, a higher percentage of pure copper can be recovered, rendering the smelting process more efficient and cost effective.

DETAILED DESCRIPTION OF A PREFERRED EMBODIMENT

Figure 1:
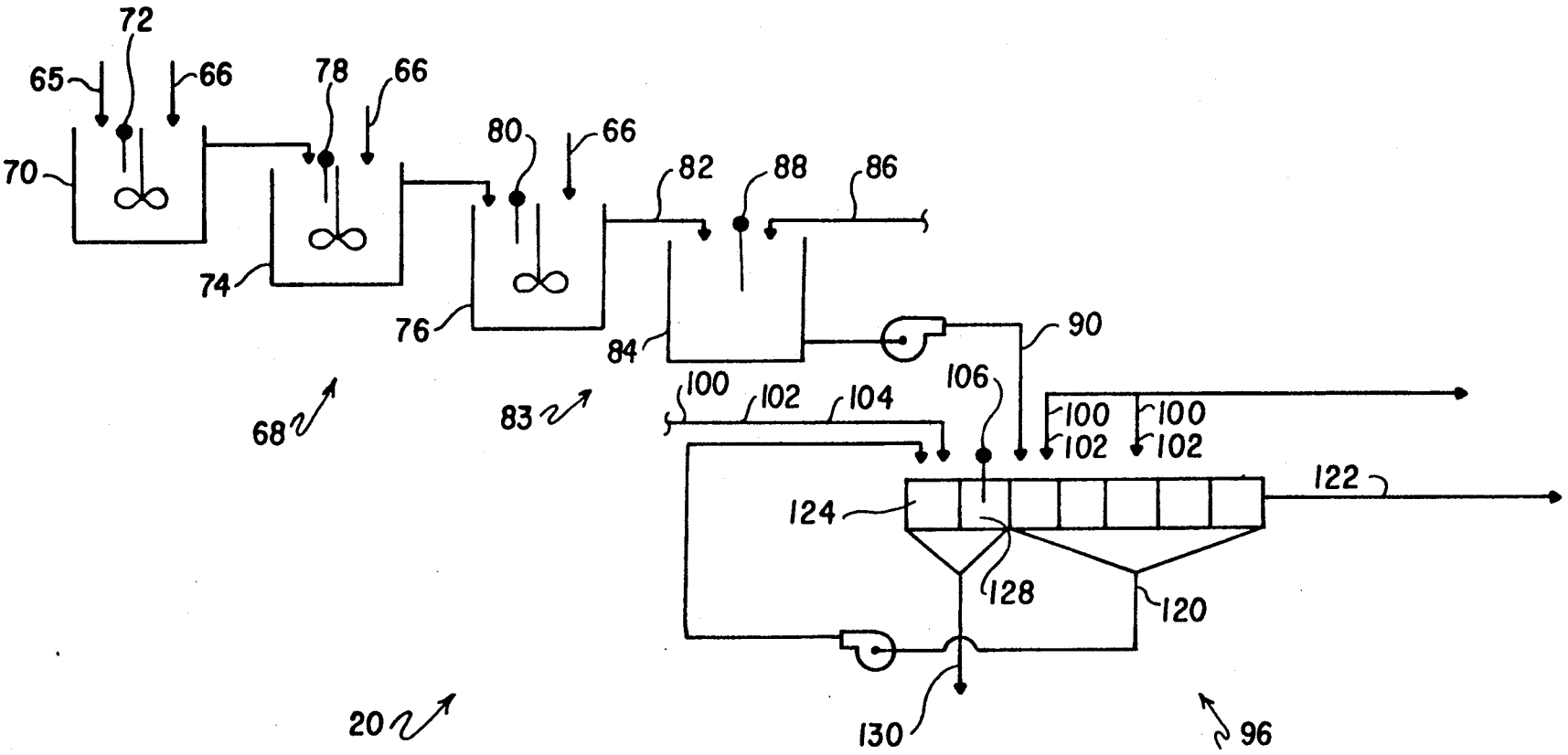
FIG. 1 illustrates an embodiment of the flotation separation process of the present invention.

The present invention is useful in the separation of chalcopyrite from rimmed iron sulfide, such as rimmed pyrite, using a froth flotation process. In a preferred embodiment, a slurry containing the minerals is conditioned with an oxidizing agent, such as peroxide, ozone or persulfate. The slurry is then conditioned with a base (e.g., lime) to raise the pH to at least about pH 9 and preferably approximately pH 11 or higher. This process depresses pyrite, while the chalcopyrite floats and is recovered as the flotation concentrate.

With reference to FIG. 1, a preferred embodiment of the ore flotation separation process is illustrated. The apparatus 20 receives a slurry of ground low grade concentrate 65, including chalcopyrite and copper rimmed iron sulfide. The chalcopyrite is separated from the rimmed iron sulfide (typically rimmed pyrite) by the novel process of the present invention.

The low grade concentrate 65 containing chalcopyrite and rimmed pyrite is obtained by first removing easily floatable non-rimmed pyrite and gangue. The low grade concentrate 65 typically contains approximately 10 weight percent to approximately 17 weight percent copper.

The low grade concentrate 65 is transferred to an oxidation and pH adjustment circuit 68. The concentrate 65 is held in aqueous suspension in tank 70 while an oxidant 66 (preferably hydrogen peroxide ($H_2O_2$)) is added thereto. Alternative oxidizing agents, such as other peroxides, ozone and persulfates can also be employed. Oxidant 66 is added while a first oxidation reduction potential (ORP) monitor 72 continuously monitors the ORP level. It has been found to be advantageous to adjust the ORP level in a stepwise manner. Therefore, as the slurry flows from tank 70 through tank 74 to tank 76, the ORP level is monitored by the first, second and third oxidation reduction potential monitors 72, 78, and 80 and appropriate amounts of oxidant 66 are added to raise the ORP level in a stepwise manner. Consequently, once the oxidized concentrate 82 leaves tank 76, the ORP level should be properly adjusted, for example, to between approximately +30 millivolts and approximately +100 millivolts.

The appropriate ORP level will vary depending on the low grade concentrate, and can easily be determined without undue experimentation. As will be appreciated by one skilled in the art, the ORP level must be greater than 0, and is preferably +20 to +500 millivolts greater than the ORP level of the low grade concentrate 65 and, more preferably, is +50 to +200 millivolts greater than the ORP level of the low grade concentrate 65. Although the amount of oxidant 66 which must be added to the low grade concentrate 65 in order to obtain the desired ORP level can vary widely, amounts varying from 1 pound hydrogen peroxide per ton of ore to about 100 pounds hydrogen peroxide per ton of ore have been found to be useful. The optimum amount of oxidant will be the lowest amount which provides the desired separation of chalcopyrite from rimmed pyrite. When determining the optimum ORP level, one can raise the ORP level in +50 millivolt increments until maximum separation in the subsequent flotation stage 96 is obtained.

The pH level of the oxidized concentrate 82 is adjusted in the pH adjustment stage 83. The oxidized concentrate 82 from tank 76 is transferred to the pH adjustment tank 84. A base such as lime (CaO) or hydrated lime ($Ca(OH)_2$) is added to the slurry by means of the base addition system 86. The base is added to the slurry until the pH sensing monitor 88 signals that the pH has been properly adjusted. In a preferred embodiment the pH is adjusted to at least about pH 9 and preferably to between about pH 11 and about pH 12.

The desired pH will depend upon the low grade concentrate 65 and the collector 102 employed in the subsequent flotation stage 96. Different collectors work most efficiently at different pHs. Typically, the pH must be at least pH 9. When certain xanthate collectors are employed, the pH is preferably greater than about pH 11. The optimum pH is the lowest pH at which effective separation of chalcopyrite from rimmed pyrite occurs in the subsequent flotation stage 96.

The properly oxidized and pH adjusted slurry 90 is transferred to the final copper flotation circuit 96. A frother 100 (e.g. MIBC) and copper collector 102 (e.g. a xanthate such as sodium and potassium salts of amyl, isopropyl and ethyl xanthate) are added to the slurry to aid in the separation of chalcopyrite from rimmed pyrite. As the slurry travels through the cells, chalcopyrite concentrate 120 is floated and collected while rimmed pyrite is collected in the tails 122, which can contain residual amounts of chalcopyrite. If desired, the tails 122 can be subjected to additional flotation.

The copper concentrate 120 is subjected to a second flotation stage in cells 124 and 128, to obtain the final copper concentrate 130. Additional frother 100, collector 102 and lime 104 can be added to cell 124. The pH can be monitored by a second pH meter 106 in cell 128. The final copper concentrate 130 can be subjected to copper recovery processes, such as smelting, in order to obtain a pure copper product.

It is important to add appropriate amounts of collector 102, which in one embodiment is xanthate, to maximize the chalcopyrite in the final copper concentrate 130. If too much copper collector is added, pyrite will float and degrade the final copper concentrate 130. If too little collector is added, a less than desirable amount of chalcopyrite will float, resulting in too much chalcopyrite in the tails 122. In order to maximize copper recovery, it is advantageous to assay (e.g. by x-ray analysis) both the floated copper concentrate 130 and the tails 122.

It is known that rimmed pyrite generally floats together with chalcopyrite. While not wishing to be bound by any theory, it is believed that the addition of an oxidant, such as hydrogen peroxide, ozone or persulfate, oxidizes the copper coating to a non-floatable oxidation state, e.g., a hydrated copper (Cu(OH), $Cu(OH)_2$) or copper oxide (CuO). It has also been found that adjusting the pH to a proper level after addition of the oxidant is important to achieve flotation selectivity. The pH level depends on the type of copper collector employed.

EXAMPLES

Examples 1 through 3 illustrate the advantages of the process of the present invention in which an oxidant, in this case hydrogen peroxide, is employed to increase the separation of chalcopyrite from rimmed pyrite. Examples 4 and 5 illustrate typical prior art processes in which an oxidant was not employed, for comparison purposes. In Example 5 the low grade concentrate feed was ground to an extremely fine size.

EXAMPLES 1-3

In the following three examples, a low grade concentrate feed was initially conditioned with hydrogen peroxide. In Example 1, 1.1 pounds of hydrogen peroxide was added per ton of solids in the feed. The initial ORP of the feed was +9 millivolts. After addition of the hydrogen peroxide, the ORP increased to +120 millivolts and later drifted downward to approximately +79 millivolts.

In Example 2, 41 pounds of hydrogen peroxide were added per ton of solids in the feed. The initial ORP was −83 millivolts before the addition of the hydrogen peroxide. After the addition of hydrogen peroxide, the ORP increased to +120 millivolts and subsequently drifted to +70 millivolts.

For Example 3, 38 pounds of hydrogen peroxide were added per ton of solids in the feed having an initial ORP of −40 millivolts. After addition of the hydrogen peroxide, the ORP increased to +120 millivolts and later drifted to approximately +70 millivolts.

In each of the three examples, the feed was conditioned with the oxidant for approximately 30 minutes. In Example 1, the feed contained approximately 40% solids, in Example 2 the feed contained approximately 25% solids, and in Example 3 the feed contained approximately 44% solids.

The oxidized low grade concentrate feed was conditioned with lime for approximately five minutes in order to obtain a pH of approximately pH 12. Isopropyl xanthate collector and MIBC frother were added to float the concentrate. Tables I, II and III below illustrate the separation obtained for Examples 1, 2 and 3, respectively. As can be seen in the column labeled "Assay % Cu", the copper assay in the concentrate greatly exceeds that found in the original feed and the amount of copper found in the tail is relatively small.

TABLE I

| Product | Wt % | Assay % Cu | Distribution Cu |
|---|---|---|---|
| Conc | 48.5 | 26.4 | 96.1 |
| Tail | 51.5 | 1.0 | 3.9 |
| Feed | 100.0 | 13.3 | 100.0 |

TABLE II

| Product | Wt % | Assay % Cu | Distribution Cu |
|---|---|---|---|
| Conc | 64.4 | 25.4 | 98.4 |
| Tail | 35.6 | 0.8 | 1.6 |
| Feed | 100.0 | 16.6 | 100.0 |

TABLE III

| Product | Wt % | Assay % Cu | Distribution Cu |
|---|---|---|---|
| Conc | 61.1 | 24.9 | 98.3 |
| Tail | 38.9 | 0.7 | 1.7 |
| Feed | 100.0 | 15.5 | 100.0 |

EXAMPLE 4

In this example, the same feed as employed in Example 1 was floated in the same manner is in Example 1, except no hydrogen peroxide conditioning was performed. As illustrated in Table IV below, the percent copper found in the concentrate is only slightly greater than the percent copper in the original feed and the tail contains a relatively high concentration of copper. As can be seen from the column labeled "Wt %," almost 90% of the original feed floated, indicating that a high percentage of rimmed pyrite floated along with chalcopyrite, leaving only about 10% of the original feed in the tail.

TABLE IV

| Product | Wt % | Assay % Cu | Distribution Cu |
|---|---|---|---|
| Conc | 89.5 | 14.0 | 95.0 |
| Tail | 10.5 | 6.3 | 5.0 |
| Feed | 100.0 | 13.2 | 100.0 |

EXAMPLE 5

In Example 5, the feed was ground to 96% −625 mesh. This extremely fine feed was floated in the same manner as in Example 4. Here the separation obtained is much better than in Example 4, but still slightly less than obtained in Examples 1, 2 and 3. Additionally, the excess grinding is an additional cost which could be avoided by employing the process of the present invention.

TABLE V

| Product | Wt % | Assay % Cu | Distribution Cu |
|---|---|---|---|
| Conc | 58.9 | 27.7 | 95.2 |
| Tail | 41.1 | 2.0 | 4.8 |
| Feed | 100.0 | 17.2 | 100.0 |

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. A method for recovering copper sulfide from a slurry containing copper sulfide and copper rimmed iron sulfide, comprising:

(a) conditioning said slurry with an effective amount of oxidizing agent to render the copper rimmed iron sulfide separable from the copper sulfide;

(b) conditioning the oxidizing agent conditioned slurry with a base to obtain a pH above about pH 9; and (c) subjecting the slurry having a pH above about pH 9 to a flotation process to recover a copper sulfide concentrate.

2. A method, as claimed in claim 1, wherein the slurry is conditioned to achieve a pH of grater than about pH 11.

3. A method, as claimed in claim 1, wherein said oxidizing agent is a peroxide.

4. A method, as claimed in claim 1, wherein said oxidizing agent is hydrogen peroxide.

5. A method, as claimed in claim 1, wherein said oxidizing agent is ozone.

6. A method, as claimed in claim 1, wherein said oxidizing agent is a persulfate.

7. A method, as claimed in claim 1, wherein said copper sulfide is chalcopyrite.

8. A method, as claimed in claim 1, wherein said iron sulfide is copper rimmed pyrite.

9. A method, as claimed in claim 1, wherein said slurry is conditioned with an oxidizing agent for a time greater than 1 minute.

10. A method, as claimed in claim 1, wherein said slurry is conditioned with an oxidizing agent for a time from about 5 minutes to about 120 minutes.

11. A method, as claimed in claim 1, wherein the slurry is conditioned with an oxidizing agent sufficient to increase the oxidation reduction potential to a level greater than 0 millivolts and wherein said oxidation reduction potential is from about +20 millivolts to about +500 millivolts greater than the initial oxidation reduction potential of the slurry.

12. A method, as claimed in claim 11, wherein said oxidation reduction potential is raised to a level from about +50 millivolts to about +200 millivolts greater than the initial oxidation reduction potential of the slurry.

13. A method, as claimed in claim 1, wherein said conditioning of the slurry with a base is conducted for a time period of at least 1 minute.

14. A method, as claimed in claim 1, wherein said conditioning of the slurry with a base is conducted for a time period of from about 5 minutes to about 120 minutes.

15. A method for recovering chalcopyrite from a slurry comprising chalcopyrite and copper rimmed pyrite, said method comprising:

(a) conditioning said slurry with an effective amount of oxidizing agent selected from the group consisting of peroxide, persulfate and ozone to render the copper rimmed pyrite separable from the chalcopyrite;

(b) adjusting the pH of the oxidizing agent conditioned slurry to above pH 11; and (c) subjecting the slurry having a pH above about pH 11 to a floatation process to float a chalcopyrite concentrate.

16. A method, as claimed in claim 15, wherein said flotation process includes the steps of:

(a) adding a copper collector to said slurry;

(b) monitoring the copper concentration in said chalcopyrite concentrate obtained from said flotation process; and (c) monitoring the copper concentration in tailings recovered from said flotation process.

17. A method, as claimed in claim 15, wherein said oxidizing agent is hydrogen peroxide.

18. A method for recovering chalcopyrite from a slurry comprising chalcopyrite and copper rimmed pyrite, said method comprising;

(a) separating easily floatable, non-rimmed pyrite and gangue from said slurry;

(b) conditioning said slurry with an effective amount of hydrogen peroxide to render said copper rimmed pyrite separable from said chalcopyrite;

(c) conditioning hydrogen peroxide conditioned slurry with lime to obtain a pH above about pH 9; and (d) subjecting the oxidized and pH adjusted slurry to a flotation process to obtain a chalcopyrite concentrate.

19. A method, as claimed in claim 18, wherein said flotation process employs a xanthate copper collector.

20. A method, as claimed in claim 18, wherein said flotation process is performed employing an MIBC frother.

* * * * *